United States Patent [19]

Lewis et al.

[11] Patent Number: 4,517,906

[45] Date of Patent: May 21, 1985

[54] METHOD AND APPARATUS FOR CONTROLLING AUXILIARY FUEL ADDITION TO A PYROLYSIS FURNACE

[75] Inventors: Frederick M. Lewis, Mountain View, Calif.; George A. Berken, Kronenwetter, Wis.

[73] Assignee: Zimpro Inc., Rothschild, Wis.

[21] Appl. No.: 528,271

[22] Filed: Aug. 30, 1983

[51] Int. Cl.[3] ..... F23G 15/00

[52] U.S. Cl. ..... 110/346; 110/187; 110/190; 110/210; 236/15 BD; 236/15 E; 431/76

[58] Field of Search ..... 110/185, 186, 187, 188, 110/190, 346, 210, 212, 214; 431/75, 76; 236/15 BD, 15 E

[56] References Cited

U.S. PATENT DOCUMENTS

| | | | |
|---|---|---|---|
| Re. 31,046 | 10/1982 | Lombana et al. | 110/187 |
| 4,013,023 | 3/1977 | Lombana et al. | 110/187 |
| 4,046,085 | 9/1977 | Barry et al. | 110/346 |
| 4,050,389 | 9/1977 | von Dreusche, Jr. | 110/346 |
| 4,097,218 | 6/1978 | Womack | 431/76 |
| 4,162,889 | 7/1979 | Shigemura | 431/76 |
| 4,182,246 | 1/1980 | Lombana et al. | 110/188 |
| 4,421,473 | 12/1983 | Londerville | 236/15 BD |
| 4,439,138 | 3/1984 | Craig et al. | 236/15 E |
| 4,474,121 | 12/1981 | Lewis | 110/346 |

*Primary Examiner*—Edward G. Favors
*Assistant Examiner*—Steven E. Warner
*Attorney, Agent, or Firm*—Allen H. Erickson; Thomas L. Johnson; B. Woodrow Wyatt

[57] ABSTRACT

A two-stage starved air furnace system is controlled to simultaneously achieve desired temperatures and percent stoichiometric air operation in the primary stage by modulating transformation relay functions acting upon measured temperature deviations to change both primary combustion air and primary auxiliary burner operation. At the set-point value of percent stoichiometric air, the relay functions are modulated in reverse direction to satisfy changing heat demands.

2 Claims, 7 Drawing Figures

| COMBUSTIBLE MATERIAL CHARACTER | PERCENT STOICHIOMETRIC AIR | SIGNAL TO BURNER VALVE | SIGNAL TO COMBUSTION AIR VALVE |
|---|---|---|---|
| HIGH HEAT VALUE | BELOW SET POINT | LOW-FIRE (RELAY FUNCTION =0.01) UNAFFECTED BY TEMP. DEVIATIONS | CONTROLLED BY TEMPERATURE ONLY (RELAY FUNCTION =0.99) |
| | AT SET POINT | MODULATING 0.01 ↕ 0.99 | MODULATING 0.99 ↕ 0.01 |
| | ABOVE SET POINT | CONSTANT 0.99 ↕ | CONSTANT 0.01 ↕ |
| LOW HEAT VALUE | AT PRE-SET CLAMPED VALUE | | AIR RATE CLAMPED AT PRE-SET DESIRED MAXIMUM PERCENT STOICH AIR |

FIGURE 6

METHOD AND APPARATUS FOR CONTROLLING AUXILIARY FUEL ADDITION TO A PYROLYSIS FURNACE

BACKGROUND OF THE INVENTION

1. Field of the Invention

The invention relates to a method and apparatus for controlling the addition of auxiliary fuel to a two-stage combustion furnace system which is operated in the pyrolysis (starved-air) mode in the first stage and in the excess air mode in the second stage.

2. Information Disclosure Statement

The incineration of combustible materials, especially waste materials such as sewage sludge two-stage "starved air" furnace systems is well known. In such furnace systems, combustible materials are incinerated under "starved air" conditions in a first stage to produce partially oxidized, combustible gases and vapors which are subsequently carried into a secondary stage where they are combusted with excess air.

An example of such two-stage incineration for incinerating sludge is a multiple hearth furnace equipped with an afterburner. In the multiple hearth furnace, the waste is pyrolized in an oxygen deficient atmosphere (i.e. under starved air conditions), which is desirably regulated to only partially complete the oxidation of the organic substances pyrolyzed from the waste. In the afterburner, air is introduced to complete the oxidation of the substances pyrolyzed from the waste in the furnace. The air supplied to the afterburner is controlled so that at temperatures above a predetermined temperature, the quantity of air introduced is increased with increasing temperatures and is decreased with decreasing temperature. In other words, the pyrolyzing furnace is caused to operate with a deficiency of air over its operating range, while the afterburner is caused to operate with excess air, i.e. above the stoichiometric value, and the amount of excess air supplied may be used not only to complete combustion but to control the operating temperatures by quenching. Examples of such two-stage systems may be found in U.S. Pat. Nos. Re 31,046, 4,182,246, 4,046,085 and 4,050,389.

As just described, when the net heating value of the waste is insufficient to maintain the desired first stage temperature, the control system will tend to increase the first stage air rate into an excess air condition, which is undesireable. Furthermore, as long as the temperature is below the set-point, the air rate will continually increase. Such increase under excess air conditions will cool rather than heat the first stage.

In reality, of course, auxiliary fuel burners are used to supplement the waste-generated heat. In order to prevent the first stage from becoming super-stoichiometric with regard to air, the auxiliary burners continuously operate at a rate which exceeds the maximum expected deficit in fuel requirement. Such operation is extremely wasteful of fuel, particularly when the feed material is usually close to or in excess of the autogenous heating value.

The problem just mentioned is addressed in co-pending U.S. patent application Ser. No. 333,102 of Lewis, filed Dec. 21, 1981. The air rate to the first stage is not allowed to exceed a pre-determined percentage of the stoichiometric rate. In other words, the first stage or primary air rate is "clamped" at a particular percentage of the stoichiometric value. In practice it would rarely be economically advantageous to operate at or close to the clamping value of percent stoichiometric air.

Still remaining, of course, are the questions of when and where the auxiliary burners should be fired. In addition, since both added air and added auxiliary fuel will increase the first stage temperature (provided the stage is in a sub-stoichiometric condition), these heat-generating steps must be continually balanced, preferably at the most economic ratio.

The degree of oxidation in the first stage will affect the quality of auxiliary fuel (if any) required to maintain the proper second stage temperature. From thermodynamic considerations it is preferred that auxiliary fuel be added to the first rather than the second stage of such two-stage furnaces. If the first stage requires auxiliary heat, the second stage generally will also. Heat supplied to the first stage is carried into the second stage.

In waste treatment applications, the terms "starved-air" and "pyrolysis" are generally applied to two-stage furnace systems, even though the first stage only is operated with less than stoichiometric air rate, and the system as a whole is fed excess air.

Furthermore, even though the terms "starved-air" and "sub-stoichiometric air" are technically more correct than "pyrolysis" in regards to the operation of the first stage, the terms will be used interchangeably in this application.

One method of illustrating the background thermodynamic principles which govern continuous combustion processes is through the use of graphs as in FIGS. 1–4, in which temperature is plotted as a function of (a) air rate or (b) percent stoichiometric air rate. The latter is the absolute air rate divided by the stoichiometric air rate required for complete combustion multiplied by 100. Furnaces for destroying waste materials are typically operated at 150+ Percent Stoichiometric Air in order to ensure complete combustion under varying feed rates, heating values and feed moisture content.

A typical graph for combustion of dry wood is shown as the upper line in FIG. 1. All of the points to the right of 100% stoichiometric air are computed using a conventional heat and material balance. When the primary combustion chamber is operated in the starved air (less than 100% stoichiometric air) mode, a combustible gas, containing carbon monoxide, hydrogen, methane, higher order hydrocarbons, along with some tars and oils, will be produced. These combustible gases are generated by the process of destructive distillation. The reactions are both endothermic and exothermic, and the exact shape of the curve in the starved air region is difficult to determine. However, for design purposes, a straight line between the known points 0% and 100% stoichiometric air is adequate.

A more typical waste material would contain moisture, and a curve for a 70% moisture wood is also shown in FIG. 1. Before a fraction of the combustible material can be reacted, all of the moisture must be evaporated (a wet ash should never leave the furnace) and this evaporation of moisture requires a significant amount of heat. In starved air operation, the quantity of air is directly proportional to the quantity of combustible material reacted. For the 70% moisture wood, slightly over 50% of the combustible material (50% stoichiometric air) must be reacted to have all of the moisture evaporated at 212° F. Typical first stage and afterburner operating points are indicated on this lower curve. The first stage is shown operating at 75% stoichiometric air with an exit temperature of 1,000° F., and the afterburner is being operated at a temperature of approximately 1,500° F. In the language of the industry, it would be stated that the afterburner is being operated at 150 percent stoichiometric (that is, 50 percent excess) air. Of course, it is more accurate to say that the furnace system, as a whole, is operating at 150 percent stoichiometric air.

In further illustrating the background to the present invention, FIG. 2 shows a similar curve for a sewage sludge with the following specific characteristics and furnace operation:

| | |
|---|---|
| Wet Feed Rate | 23600 lb/hr |
| Moisture Content | 73% |
| Combustible Content (Dry Basis) | 65.4% |
| High Heating Value of Combustibles | 12000 BTU/lb |
| Combustible Elemental Analysis | |
| C | 57.33% |
| H | 8.13% |
| S | 1.24% |
| O | 28.45% |
| N | 4.85% |
| Total | 100.00% |

The calculations include heat losses by radiation and convection, heat loss associated with the combustible material which will remain in the ash, and the heat loss from the sensible heat in the ash.

It should be recognized that the curve for actual waste streams such as partially dewatered sewage sludge varies from instant to instant. Higher heating values and/or less moisture will affect the curve on either or both sides of the 100 percent stoichiometric value.

FIG. 3 shows combustion curves for the same sludge as in FIG. 2. The "NO FUEL" line is identical to the curve of FIG. 2. and represents the sludge alone, without any auxiliary fuel. The maximum temperature achievable with this sludge alone is about 1460° F. If the first stage is operated at 1400° F., an actual air rate of 32,000 pounds per hour is 97 percent of the stoichiometric rate of 33,000 pounds air per hour. This "percent stoichiometric air" is considerably higher than the exemplary desired value of 90 percent. The desired first stage temperature is 1400° F. and desired percent stoichiometric air of 90 percent can only be achieved by introducing and combusting an auxiliary fuel in the first stage. In this example auxiliary fuel is also required in the afterburner. The total auxiliary fuel used to achieve 1400° F. furnace offgas temperature is 5.58 million BTU/hr. The fuel addition to the afterburner needed to maintain a 1400° F. offgas temperature is 0.36 million BTU/hr for a total of 5.94 million BTU/hr of auxiliary fuel. The "combustion path" is indicated on the figure. It can be seen that the percent stoichiometric air is now 34,000 pounds per hour divided by 37,800 pounds per hour, times 100, or 90 percent. The total air rate to both stages is shown to be 53,000 pounds per hour (140 percent of stoichiometric) and the afterburner temperature is controlled at 1400° F.

FIG. 4 is a replot of FIG. 3 where the Percent Stoichiometric Air is used as the abscissa rather than the air rate. The set point of 90% stoichiometric air to the furnace is used to obtain a 1400° F. furnace temperature as indicated.

The effects of fuel, air, and combustible waste characteristics upon the operation of any furnace can be clearly visualized from such an analysis.

It is an object of this invention to provide a two-stage "starved-air" furnace system capable of efficiently combusting waste materials of varying heating value and moisture.

A further object of this invention is to provide a furnace system in which the primary stage is maintained in the "substoichiometric air" mode, despite large variations in feed rate, moisture contents and heating value.

A further object is to provide a furnace in which auxiliary fuel is preferentially supplied to the first stage rather than the second stage, in order to achieve the most efficient use of the auxiliary fuel.

Yet another object is to maintain temperatures in both stages at relatively uniform levels.

A further object is to provide a furnace in which the air rate to the primary stage is maintained at a uniform fraction of the stoichiometric requirement, despite rapid changes in the absolute value of the stoichiometric requirement.

Another object is to provide a furnace in which the control is based on criteria which are easily measured on a continuous basis.

It is an additional object of the present invention to provide an improved method of controlling the incineration of combustible materials in the starved-air mode which enables operation of the primary stage close to the stoichiometric point, and maintaining an identifiable safety margin to prevent instability problems.

SUMMARY OF THE INVENTION

This invention relates to a method for controlling the operation of a two stage furnace to efficiently incinerate combustible material in a starved-air mode, a primary or first stage having means to introduce combustible material therein as well as auxiliary fuel burner(s) and combustion air flow means for introducing flows of auxiliary fuel-air mixture and combustion air, respectively, into said primary stage at substoichiometric air conditions to pyrolyze the combustible material at predetermined set point(s) and a secondary stage connected to said primary stage to receive gas and vapor products from said primary stage, said secondary stage being operated at excess air conditions at a predetermined minimum temperature to combust said gas and vapor products from the primary stage, and wherein the combusted gas and vapor products are discharged as flue gas from the secondary stage.

The method comprises:

(a) measuring the oxygen concentration in the flue gas discharged from said secondary stage;

(b) measuring the air flow rates to each of the primary and secondary stages of said furnace system, and using said measured rates and said measured oxygen concentration to compute the primary stage air rate as a percentage or fractional value of the stoichiometric air rate;

(c) establishing a predetermined set-point control value of said primary stage percent stoichiometric air to achieve the desired efficient furnace operation;

(d) comparing said computed percent stoichiometric air value from step (b) with said predetermined set-point control value of primary stage percent stoichiometric air;

(e) establishing a predetermined set-point control value of primary stage temperature;

(f) measuring said primary stage temperature and comparing said primary stage temperature with said predetermined set-point control value of primary stage temperature;

(g) controlling said flows of auxiliary fuel-air mixture to said burner(s) and air to said combustion air flow means to simultaneously maintain said primary stage temperature at its predetermined set-point control value and said primary stage percent stoichiometric air at its predetermined set-point control value, said control of primary stage comprising:

(i) correcting variations in first stage temperature to the predetermined temperature set-point value by regulating changes in flow rate of said auxiliary fuel-air mixture at a pre-set minimal relay function and regulating changes in said combustion air flow rate at a pre-set maximum relay function, provided computed primary stage percent stoichiometric air is below the said predetermined set-point control value of percent stoichiometric air in the primary stage;

(ii) regulating changes in flow rates of said fuel-air mixture and said combustion air when said computed primary stage percent stoichiometric air is at the predetermined set point value wherein as the heat required to maintain said predetermined set-point temperature increases, the relay function for regulating said fuel-air mixture is continuously modulated from said pre-set minimum value to a pre-set maximum value, and the relay function for regulating said combustion air rate is continuously modulated from said pre-set maximum value to a pre-set minimum value, the resulting said changes in flow rates acting to satisfy said heat requirement without changing said computed primary stage percent stoichiometric air; and (iii) correcting variations in the temperature in said primary stage to the predetermined set-point value, when said computed primary stage percent stoichiometric air exceeds the pre-determined set point control value wherein the relay function for regulating said fuel-air mixture is at the pre-set maximum value, and the relay function for regulating said combustion air mixture is at the pre-set minimum value.

Relay function is defined as the transformation performed upon an input signal to produce an output signal. The input signal may be a measurement, or a particular function of a measurement (such as deviation of the measured value from a control set-point), and the output may operate upon a final control element like a valve, or may be further transformed in another relay device.

BRIEF DESCRIPTION OF THE DRAWINGS

The accompanying drawings, which constitute a part of this specification, serve to explain the principles of this invention and illustrate the embodiments thereof.

FIG. 6 is a diagram showing the interaction of percent stoichiometric air and temperature measurements upon relay function and control of auxiliary fuel and air.

DESCRIPTION OF THE PREFERRED EMBODIMENTS

Figure 1:
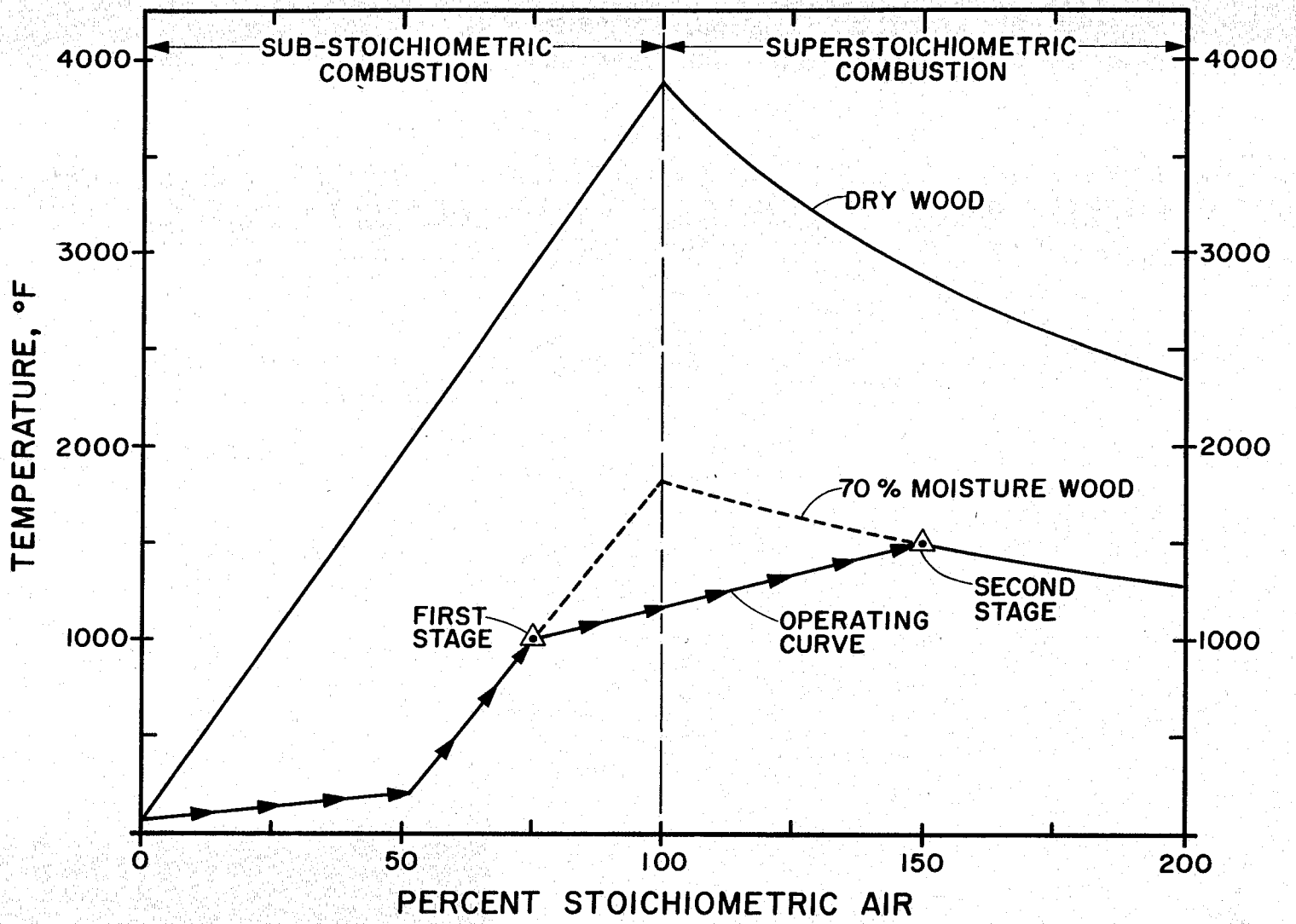
FIG. 1 is a plot of furnace temperature as a function of percent stoichiometric air supplied to the furnace. Curves for a typical dry wood and wood having 70 percent moisture are shown.
Figure 2:
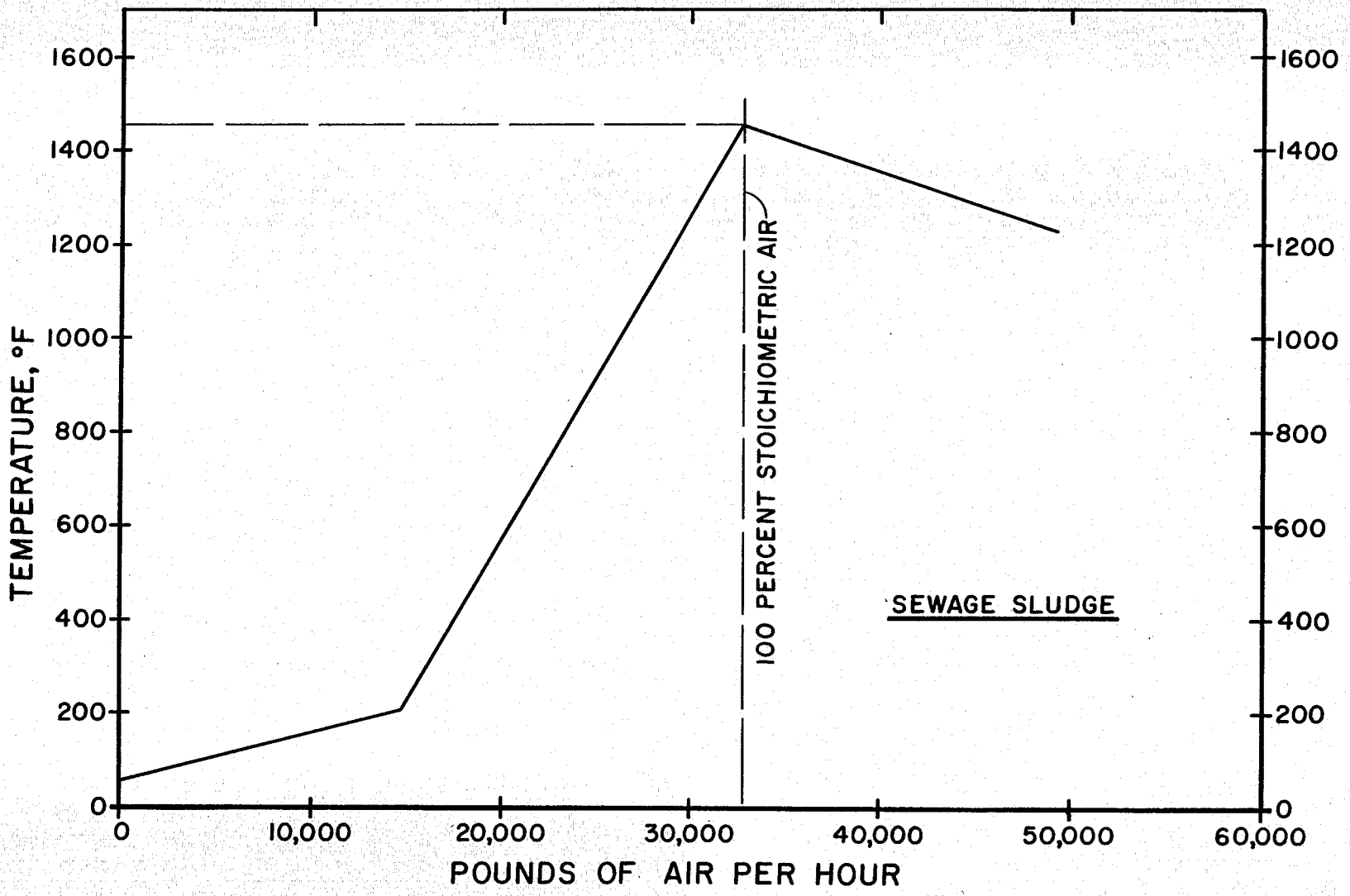
FIG. 2 is a plot similar to FIG. 1, for a typical sewage sludge, having temperature plotted against absolute air flow rate.
Figure 3:
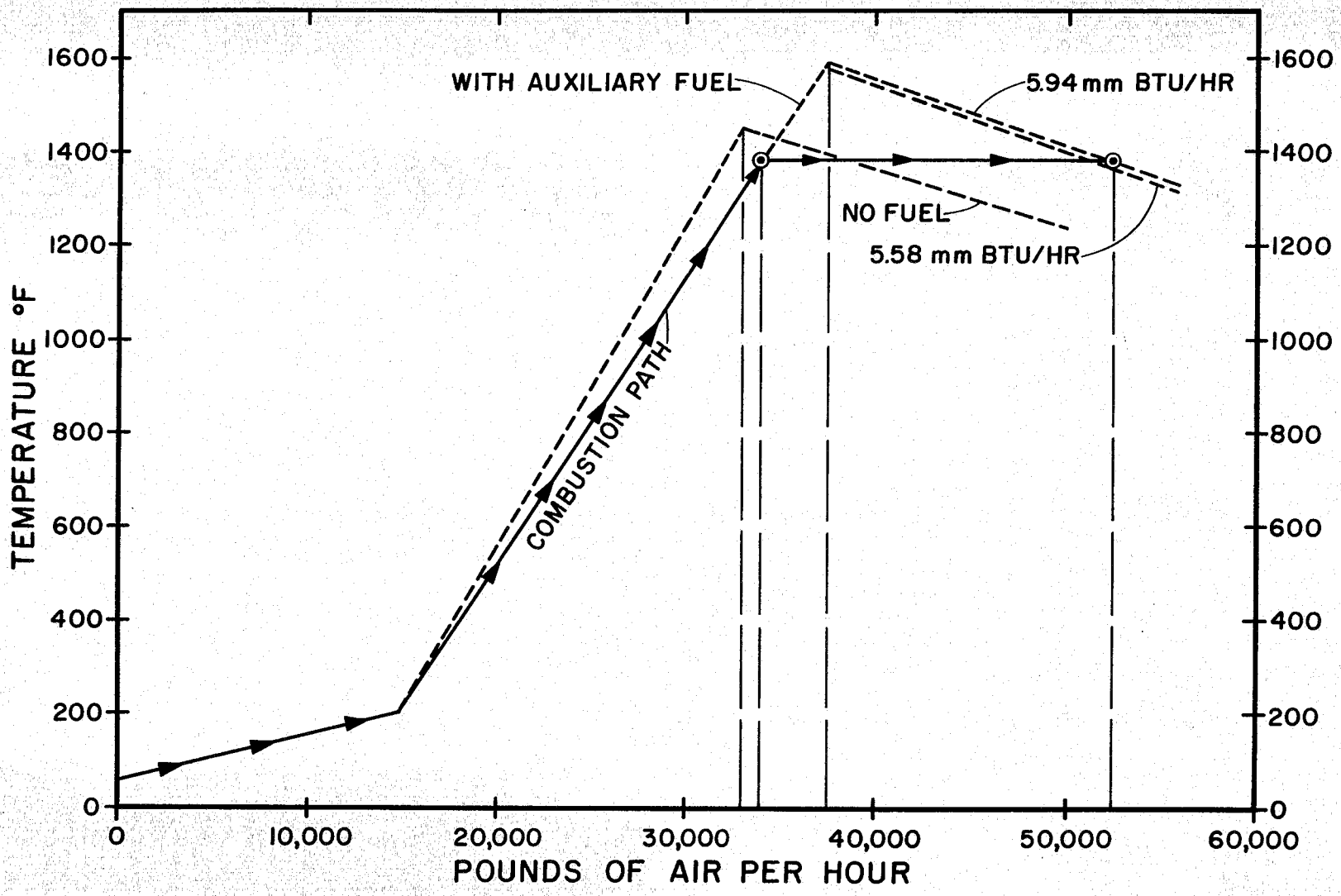
FIG. 3 is the same plot as FIG. 2, showing the effects of supplying an auxiliary fuel to the first stage of a two-stage furnace.
Figure 4:
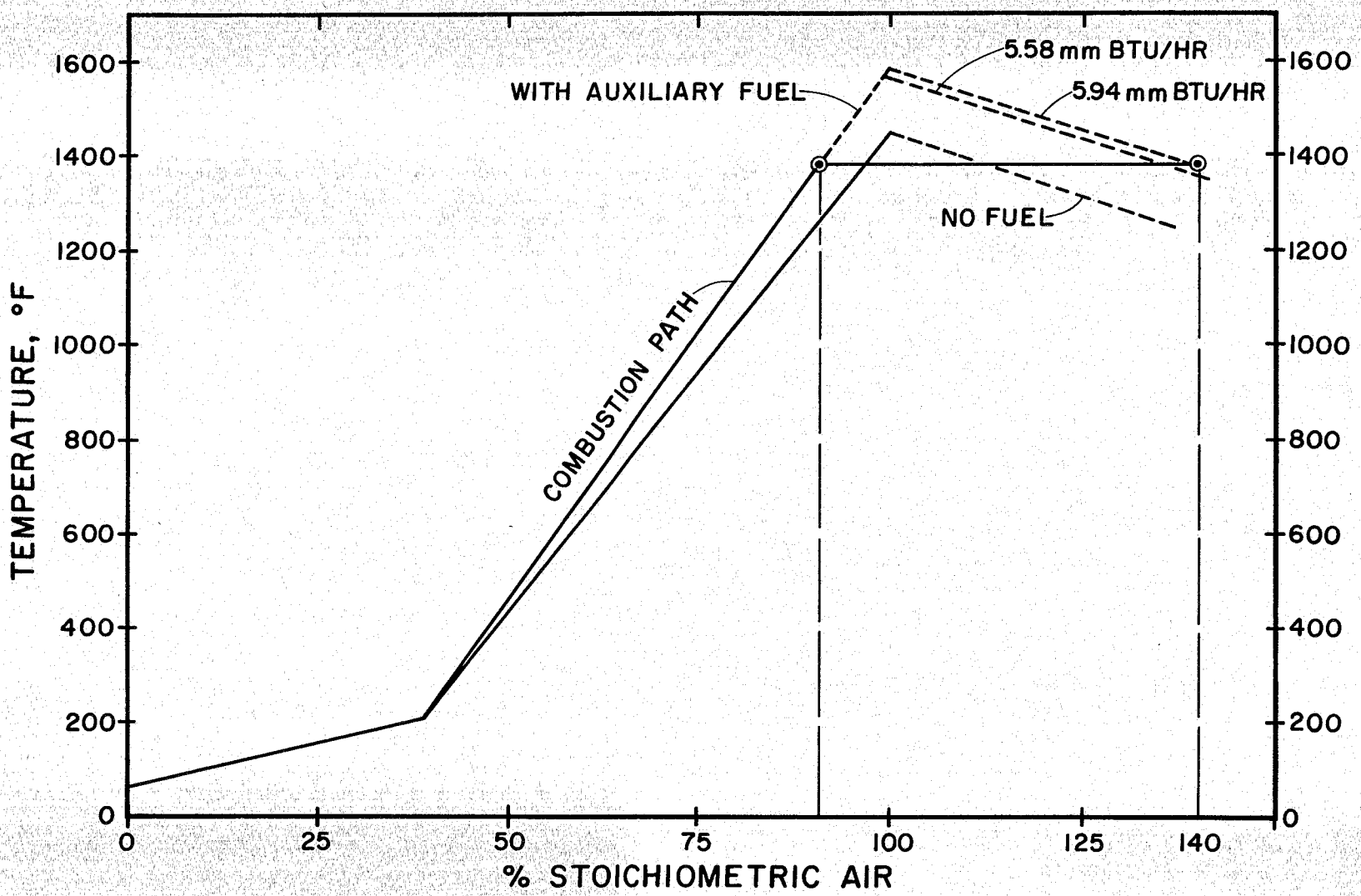
FIG. 4 is a replot of FIG. 3 having air rate on a relative basis (percent stoichiometric air).
Figure 5:
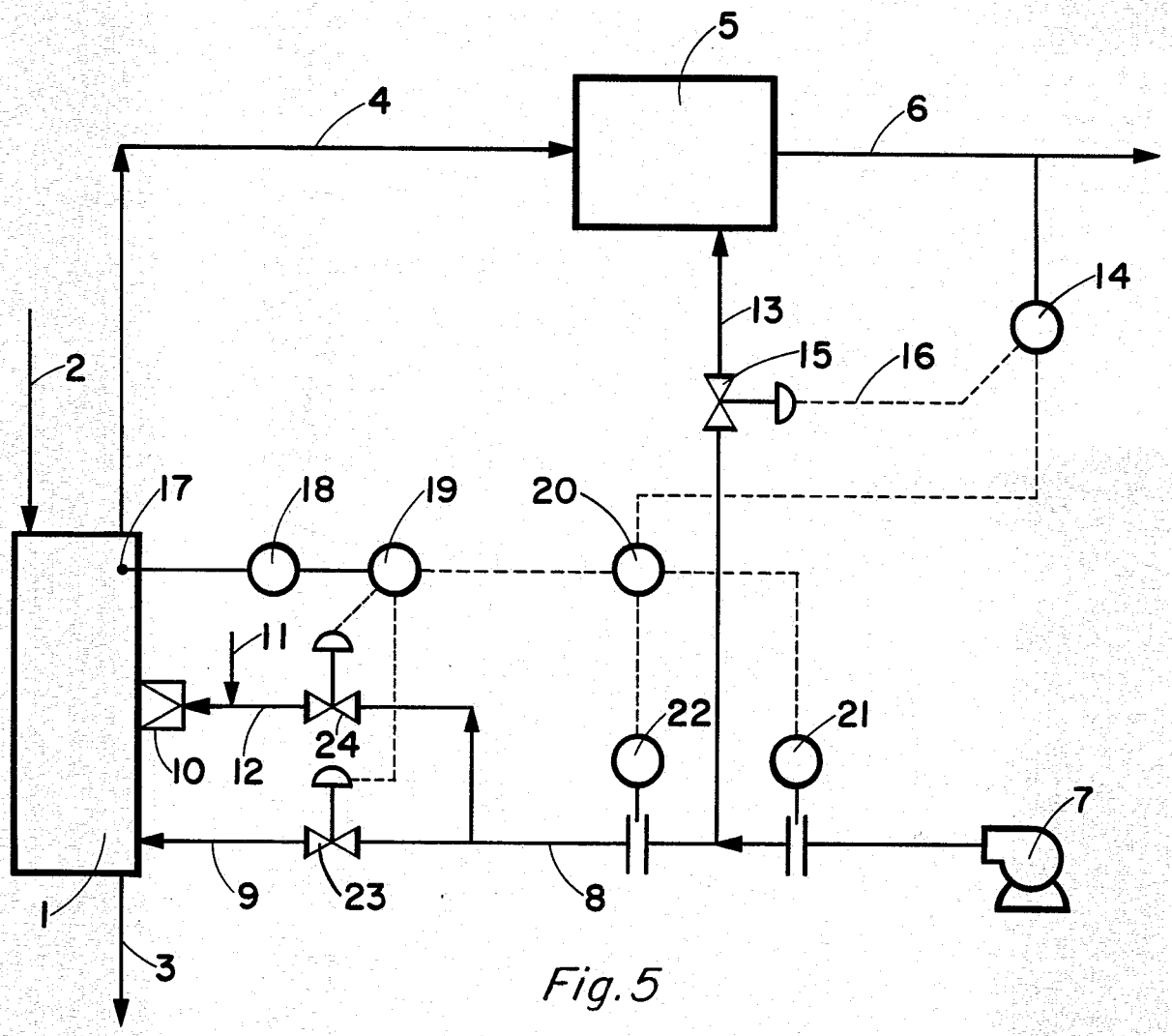
FIG. 5 is a schematic of the control process and apparatus of this invention.

FIG. 5 is a schematic of the control system. The first stage or primary combustion chamber 1 of a two-stage starved-air combustion system receives a waste material 2 and discharges residual inert solids as ash 3. Exhaust gases and vapors 4 from said first stage are transported to and combusted in the second stage 5, commonly called an afterburner, and discharged as flue gas 6.

Typical operating temperatures are in the range of 1400° to 2000° F. for the primary stage, and 1600° to 2400° F. for the secondary stage. The particular combustion temperatures used depend upon properties of the waste being combusted as well as furnace design and materials of construction.

Air is supplied to both stages by blower or blowers 7. Air 8 to the first stage is supplied through one or more combustion air inlets 9 as well as through auxiliary fuel burner or burners 10, supplying heat by burning fuel 11 with air 12. In actual practice, burner air 12 may be supplied from a different source than combustion air 8. Air is supplied to the first stage 1 at a sub-stoichiometric rate; this is commonly known as pyrolysis or starved-air combustion. Exhaust gases and vapors 4 primarily comprise CO, $CO_2$, $N_2$, various organics, water vapor, and a small percentage of unused $O_2$.

Air 13 is supplied to the afterburner 5 at a rate which is in excess of the stoichiometric requirement of the combustible materials entering the second stage.

The air rate to the primary stage is increased to increase primary stage temperature, while the air rate to the afterburner is decreased to increase afterburner temperature.

Means for controlling the afterburner temperature are not shown, but typically include an auxiliary fuel burner which is operated at a level exceeding low fire, when required, to maintain the minimum desired temperature.

The oxygen concentration in flue gas 6 is determined by oxygen measurement/control means 14, which regulates valve or damper 15 through conduit 16 to maintain the overall excess oxygen in the second stage flue gas at or above a minimum desired level, resulting in essentially complete combustion of the gases and vapors.

With respect to control of the primary chamber 1, temperature sensor means 17, for example a thermocouple, provides a signal to temperature indicator/controller 18. This may be a conventional temperature controller which can be set to maintain a desired temperature and which responds to the temperature sensed by sensor 17 to produce an output depending on whether the temperature sensed is above or below the set point on the controller. The output of the temperature controller 18 is supplied to a temperature ratio relay means 19 which also receives signals from set point controller means 20, which in turn receives signals from oxygen measurement/control means 14 as well as from total air flow measurement means 21 and primary air flow measurement means 22.

The function of set point controller means 20 is to:

1. receive measurement of:
   a. flue gas oxygen content
   b. total air flow rate and
   c. primary air flow rate.
2. determine whether the primary air rate should be adjusted to maintain the primary rate at or below a predetermined set-point of percent stoichiometric air, and
3. transmit an output signal to temperature ratio relay 19.

Temperature ratio relay means 19 serves to control the first stage temperature by increasing airflow through main air valve 23 when the temperature is below the setpoint value, provided the signal from set point controller means 20 indicates that the primary air rate is not in excess of the set point percent stoichiometric value.

The other means of increasing the primary chamber temperature is by burning auxiliary fuel 11 in burner 10. Auxiliary fuel 11, typically natural gas or fuel oil, is burned with an approximate stoichiometric ratio of air 12. The rate of both auxiliary fuel 11 and air 12 is regulated by temperature ratio relay means 10 as it varies the setting of valve 24.

When set point controller means 20 determines from its input signals that the first stage has exceeded the percent stoichiometric air rate setpoint by some quantity, its output to ratio relay means 19 together with the output from temperature controller 18, serves to regulate both the combustion air valve 23 and burner valve 24 to simultaneously achieve the desired first stage temperature and desired percent stoichiometric air rate (or less) using a minimal quantity of auxiliary fuel.

At the set point value of percent stoichiometric air, the signals to the burner valve 24 and the combustion air valve 23 will continuously modulate, the total effect resulting in the production of heat necessary to maintain the first stage temperature, while simultaneously maintaining the stoichiometric air rate set point. As the percent stoichiometric air rate tends to exceed the set point value, the controller logic acts to provide two relay functions (for burner 10 and combustion air inlet 9, respectively) which when multiplied by a function of the first stage temperature deviation will, in combustion, return the temperature to its desired control point.

The ratio of heat supplied by burner 10 and heat supplied by additional combustion air inlet 9 is continuously modulated in this manner so that as the heat requirement continually increases (at constant percent stoichiometric air), the signal to the burner valve 24 represents a continually larger portion of the required heat addition and the signal to the combustion air valve 23 represents a continually smaller portion of the heat addition.

In no case do set point controller means 20 and/or ratio relay means 19 shut off either the burner or the combustion air. The burner is always operating, and there is always combustion air while the furnace is operating.

If the gases and vapors entering the afterburner contain insufficient heating or calorific value to maintain the afterburner at the desired temperature, additional auxiliary fuel such as natural gas is supplied to the afterburner by means not shown on FIG. 5.

In this way, when waste characteristics are such that there is insufficient heat available to maintain the required combustion temepratures at the set-point value of percent stoichiometric air in the primary chamber, auxiliary fuel is supplied to burner 10 at a rate which provides the minimum heat required to offset the heat deficit to achieve the desired result:

(a) the first stage is controlled at a uniform temperature;
(b) The air supplied to the first stage is controlled at a uniform percentage of the stoichiometric value;
(c) the first stage is always operated in a starved-air mode; and
(d) auxiliary fuel is preferentially added to the first stage rather than the second stage.

We shall now describe the invention and its operation in more detail, as illustrated by FIG. 6. FIG. 6 shows the action of the primary stage burner valve and combustion air valve in several regions of operation. At the upper end is shown a combustible material having a high heating value. For sake of example, let us assume that a percent stoichiometric air rate of 85 is to be the set point which in this invention means that operation at values less than 85 are also permissible; and the primary stage temperature is to be controlled at 1400° F.

At some high heating value the percent stoichiometric air will be less than 85. Temperature control is achieved by regulating the combustion air flow only. Auxiliary fuel is added at minimum value to maintain the burner at a low-fire condition. This is a safety measure to ensure a continuous flame in the primary stage. It can be seen that the relay function, which multiplied by the temperature deviation comprises the output signal (So) to the burner valve remains at a minimum. On the other hand the relay function for the combustion air valve is at its maximum (or high) value. For sake of illustration, the signals to the burner valve and to the combustion air valve are operated over a range of 0.01 times input (minimum value) to 0.99 times input (maximum value).

As the heating value of combustible material falls (or moisture content increases) the temperature controller 18 will demand more heat input from the burner 10 and combustion air inlet 9. Initially only the air valve will respond since the stoichiometric air value is below the set point but eventually the percent stoichiometric air will reach the set point of 85. At this point, the burner will begin to fire at an increasingly higher rate, and the combustion air valve will open at a decreasing rate, the two actions combining to exactly overcome the heat deficit, while adding fuel and air at rates which will maintain the desired 85 percent stoichiometric air.

As the heat deficit of the combustible material becomes increasingly larger, eventually the relay function for the burner(s) will be at its maximum (0.99) and the signal function for the combustion air valve will be at the minimum value (0.01). This is equivalent to the highest heat deficit at which the percent stoichiometric air can be maintained at the set point of 85. Any further heat deficit will be, for all practical purposes, offset by increases in auxiliary fuel to the burner only and not by increases in combustion air. Such burner operation will of course increase the percent stoichiometric air above the set point (ie., 85), since the burner(s) itself is generally operated at a stoichiometric or greater air rate.

It is desireable to prevent the percent stoichiometric air from exceeding some maximum value, for example 90. In such a case, the controller may be set to turn down all of the sludge combustion air going to the furnace so that the maximum set point of stoichiometric air is not exceeded. Optionally the controller may be set to reduce the operating temperature or shut down the furnace at the maximum percent stoichiometric air value, since it is impossible to simultaneously maintain 90 percent stoichiometric air with further increasing heat deficit.

Figure 7:
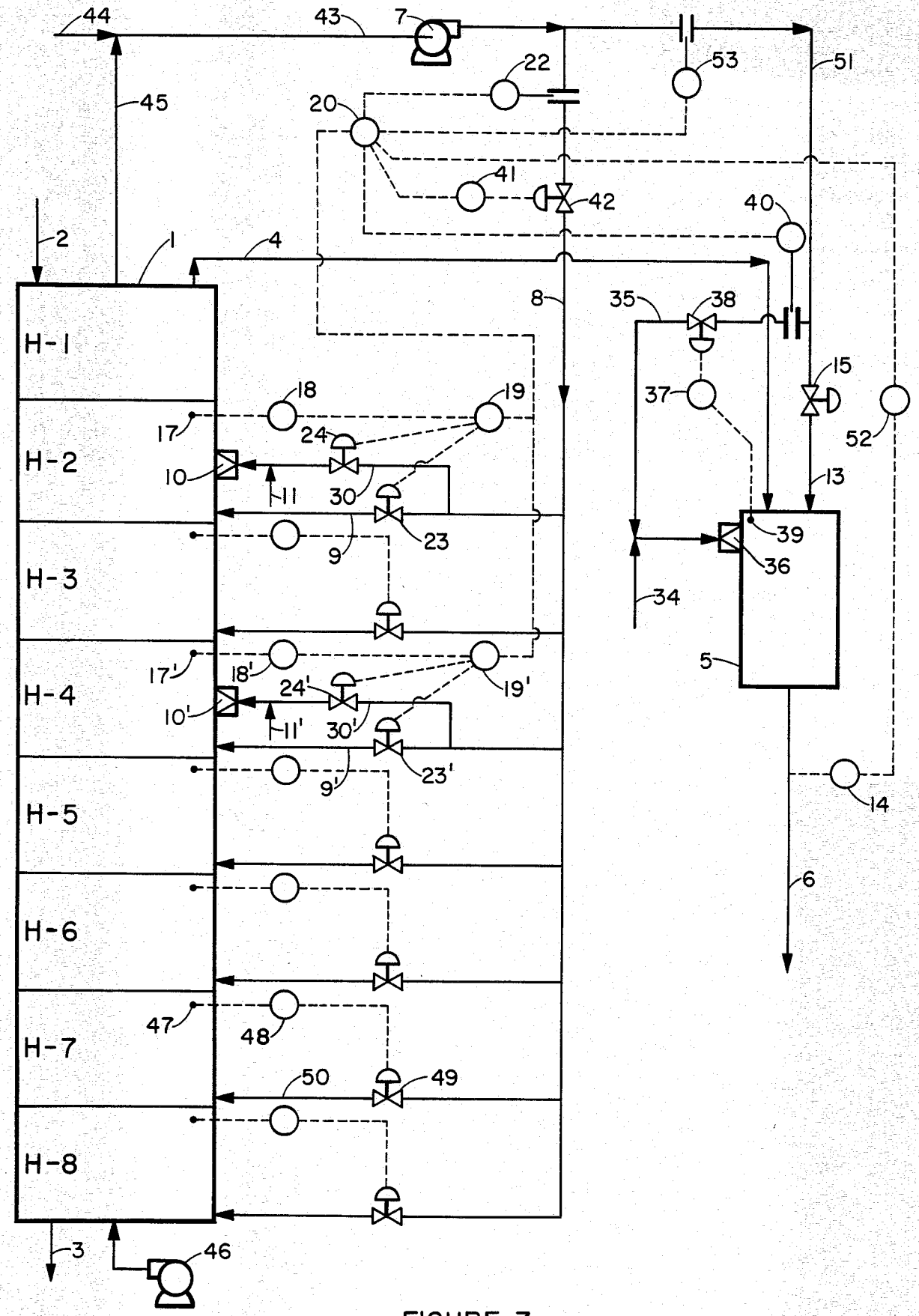
FIG. 7 is a schematic drawing showing an embodiment of the control method and apparatus as applied to an exemplary multiple hearth furnace operated with substoichiometric air rate, having an afterburner.

This invention is especially applicable to control of two-stage furnace systems where the first stage is a multiple hearth furnace. FIG. 7 illustrates an eight-hearth furnace 1 which may have individual hearths H-1 through H-8 with varying percent stoichiometric air on each hearth. Some hearths may even be operated with excess air for the particular quantity of combustibles passing through the hearth, but the overall air rate to the multiple hearth furnace comprising the primary stage is substoichiometric. For example, hearths H-1 through H-5 may be operated with substoichiometric air and hearths H-6 through H-8 operated with excess air to complete combustion of fixed carbon and other combustible matter associated with the ash, and to cool the ash.

Combustible matter 2 such as sewage sludge or other waste material is introduced to the upper hearth(s), and ash 3 is discharged from the lowest hearth. Air 43 supplied to the furnace system may be fresh air 44 or shaft cooling air 45 supplied by blower 46, or air from any other source in any proportion. Air for primary stage combustion, primary stage auxiliary fuel burners and secondary stage combustion and burners is supplied by blower 7.

Any combination of blowers may alternately be used.

In this example, only hearths H-2 and H-4 have auxiliary fuel burners 10 and 10'. On the other hand, all hearths except H-1 have temperature control means based on varying the rate of combustion air. On hearths H-2 through H-5, operating with substoichiometric air rate, the air rate is increased to increase hearth temperature. On hearths H-6 through H-8, the air rate is reduced to increase heart temperature.

Therefore, hearths H-3 and H-5 through H-8 have temperature control means comprising temperature sensors 47, temperature indicator/controllers 48, and combustion air control valves 49 which regulate the air 50 supplied to each hearth. For clarity in FIG. 7, control means are labelled only for hearth H-7.

Vapors and gases 4 resulting from the starved air combustion in primary stage H-1 are conducted to afterburner 5 and combusted with excess air 51.

Measurement means which are part of the control system include:

(a) oxygen concentration measurement means 14 which determines the oxygen concentration in flue gas 6 and whose measurement or function thereof is transmitted to afterburner airflow controller 52 and/or set point controller means 20;

(b) air flow measurement means 22 which measures essentially the total airflow 8 to the primary stage and transmits the measurement or a function thereof to set point controller means 20;

(c) air flow measurement means 53 which measures essentially the total airflow 51 to the secondary stage 5 and transmits the measurement or a function thereof to set point controller means 20. In an alternative form, the total air flow 43 and either of airflows 51 or 8 is measured, and the other airflow is calculated, and (d) temperature sensors 17 and 17' which supply signals to temperature controllers 18 and 18' respectively.

Final control elements include combustion air control valves 23 and 23' which control combustion air rate 9 and 9' over a wide range of flow, and auxiliary fuel burner control valves 24 and 24' which serve to control the rate at which the mixture of auxiliary fuel 11 and air 30 (and the mixture of fuel 11' and air 30') are introduced into hearths H-2 and H-4 respectively.

These final control elements are regulated by temperature ratio relay means 19 and 19', based on the measurements of hearth temperature, flue gas oxygen concentration and air flow rates.

One method of controlling the afterburner temperature is illustrated in FIG. 7. The rate of afterburner combustion air 13 is controlled by control valve 15 to maintain a desired percent stoichiometric air, for example 140 percent, in the afterburner, as determined from measurement of the flue gas oxygen concentration. Additional heat is supplied by combusting a nearly stoichiometric mixture of auxiliary fuel 34 and air 35 in burner or burners 36. The rate of such addition is controlled by afterburner temperature controller 37 acting through control valve 38 to maintain the desired temperature as measured by temperature sensor 39. The source of air 35 may be a separate blower (not shown).

In this particular embodiment of the invention the rate of air flow 35 to second stage burner 36 is measured by air flow measurement means 40 which relays a signal to set point controller means 20. Alternatively, the rate of auxiliary fuel 34 may be measured, or if the burner air rate is a miniscule portion of the total air rate, its rate may be ignored in the calculations used to control the primary stage. When the rate of air 35 is not included in the measurement of flowmeter 53, the calculation formuli are changed. Such will occur when air 35 is obtained from a separate source.

FIG. 7 also shows a means for preventing the primary stage from exceeding a predetermined percent stoichiometric air value. When the heating value and/or moisture content of the combustible material fed to the furnace is such that the auxiliary fuel burners 10, 10' are fired at a very high rate, it may become impossible to maintain both the desired temperature and first stage percent stoichiometric air. Clamp valve 42 is controlled by controller means 41 acting in accordance with a signal from set point controller means 20 to prevent the primary stage air rate from exceeding the desired maximum value of percent stoichiometric air.

The stoichiometry of the furnace system is determined by measuring the final exhaust (flue gas) oxygen content (downstream of the afterburner) and all of the air flowing into the combustion system. The overall oxygen content determines the overall system stoichiometry. For example, if the exhaust oxygen content is 6% by volume, then the overall stoichiometric value is determined to be 140% by the following formula:

$$S_T = \left[ 1 + \frac{O_2}{(21 - O_2)} \right] \times 100\% \quad (1)$$

where $S_T$=percent stoichiometric airflow value for the system, and $O_2$=volume % oxygen in the flue gas. Therefore the system is operating at 140% of stoichiometric. Assuming no auxiliary fuel is used in the secondary chamber (or afterburner), then the total air supplied to the system is 1.4 times the amount needed for stoichiometric combustion. Therefore it is simple to find the air rate required for any stoichiometric (or substoichiometric) operation by use of the following:

$$\frac{A_F}{A_T} = \frac{S_F}{S_T} \quad (2)$$

where $A_F$=measured air flow to primary stage $A_T$=measured total air flow to system for combustion of sludge and fuel supplied to the system $S_F$=measured percent stoichiometric airflow in the primary stage $S_T$=measured/calculated percent stoichiometric airflow for the system Rewritten, this equation can be used to determine the desired air flow $A_F$ to the primary stage as follows:

$$A_F = A_T \frac{S_F}{S_T} \quad (3)$$

Conversely, the actual percent stoichiometric airflow value $S_F$ in the primary stage is defined by:

$$S_F = A_F S_T / A_T \quad (4)$$

For the apparatus of the present invention, the value $S_F$ is obtained by measuring the air flows into the apparatus along with the oxygen content and, using the above formula, calculating the value $S_F$. To this end the gas flow measurement $FT_{53}$ for the air flow to the afterburner 5, $FT_{40}$ for the fuel combustion air flow to the afterburner 5, $FT_{19}$ and $FT_{19'}$ for the fuel combustion air flow to the hearth burners 10, 10', and $FT_{22}$ for the primary stage air flow are provided which sense the air flow to these parts of the system. The output from these sensors are supplied to the stoichiometric value calculator 20 where they are used in the formula:

$$S_F = \frac{S_T FT_{22}}{FT_{22} + (FT_{53} - FT_{40}) - FT_{40}\left[\frac{S_T - S_B}{S_B}\right]} \quad (5)$$

where

FT represents the air flow sensed by the subscript indicated flow meters 22, 40 and 53;

$S_T$ is as before;

$S_F$ is as before;

$S_B$ is the percent stoichiometric air used in the afterburner burner 36.

It will be seen that this formula is the same as formula (4), the numerator being the measured or calculated percent stoichiometric airflow for the system, multiplied by the measured air flow $A_F$ to the furnace 1 and the denominator being the measured total air flow $A_T$ to the system with a correction factor for the burning of fuel in the afterburner burner 36.

Typically the system is operated at a desired percent stoichiometric air value $S_F$ of from 80 to 90% of stoichiometric, and set point controller 20 is set at this value.

If the actual stoichiometry of the furnace should attempt to change from this value, then the controller 20 takes action to change the input to the furnace.

As pointed out above, the hearth temperature control loop is maintaining each hearth at a predetermined temperature by control of the auxiliary fuel combustion air flow and the sludge combustion air flow. If the nature of the sludge supplied to the furnace changes, the first effect will be to change the temperature of the hearths. The temperature controller 18 would cause the temperature relay 19 to increase the fuel combustion air rate to increase the firing rate of the burners and to increase the sludge combustion air rate, maintaining temperature according to the hearth temperature control loop.

To clearly understand how such a change in sludge affects the operation of the furnace and how the second control loop acts to overcome the effect of this change and maintain the desired percent stoichiometric air value, the overall energy balance in the primary chamber, here the furnace, must be understood.

This energy balance can be expressed as:

$$(E_c - E) + E_b = L_w + L_c + L_{misc} \quad (6)$$

where $E_c$ is the total chemical energy, e.g. in BTUs, of the combustibles in the sludge and E is the chemical energy of the combustibles not burned in the furnace;

$E_b$ is the total chemical energy in fuel added to the primary chamber;

$L_w$ is the water load, i.e. the energy required to heat the water in the sludge and then vaporize it;

$L_c$ is the combustibles load, i.e. the energy required to heat and volatilize the combustibles in the sludge; and $L_{misc}$ is the load due to various heat losses in the system, e.g. loss through the shell and the like.

The relationship of the amount of air needed in the furnace to burn the materials in the furnace is:

$$K \frac{A_c + A_b}{E_c + E_b} = S_F \quad (7)$$

where $A_c$ is the air needed to burn the combustibles in the sludge;

$A_b$ is the air needed to burn the auxiliary fuel added to the furnace; and

K is a proportionality constant to convert energy release, in BTUs to air flow.

When the sludge changes in a way to change the load, for example by a change in the amount of water or a change in the amount of combustibles, while the energy $E_c$ of the combustibles remains constant, $L_w$ and/or $L_c$ will change correspondingly, requiring a change in the amount of fuel added to the furnace to keep equation (6) in balance.

For example, when the amount of water in the sludge increases, while other factors remain the same, the temperatures in the burner hearths will decrease. Taking hearth H-2 for example, this will result in temperature controller 18 to cause corresponding relay function 19 to increase the flow of fuel combustion air and sludge combustion air through valves 24 and 23, respectively.

In equation (7) this will cause an increase in $A_c$ and $A_b$ by $\Delta A_{c1}$ and $\Delta A_{b1}$ respectively. The change in $A_b$ in turn will increase $E_b$ by $\Delta E_b$ since the proportions of fuel and air to the burner remain constant. Thus $$\frac{A_b}{E_b} = \frac{A_b + \Delta A_{b1}}{E_b + \Delta E_{b1}} \tag{8}$$

and thus from equation (7)

$$K\left[\frac{A_c + \Delta A_{c1} + (A_b + \Delta A_{b1})}{E_c + (E_b + \Delta E_{b1})}\right] > \text{starting } S_F \tag{9}$$

As can be seen, the temperature control action has changed the percent stoichiometric air value $S_F$ for the hearth in question.

After a time, the oxygen sensor 14 downstream of the afterburner senses the change, less combustibles being present in the combustible gases from the furnace, and controls valve 15 to admit less air to the afterburner. This is sensed by gas flow sensor 53 which in turn changes the input to the stoichiometric controller 20. As a result the actual stoichiometric value $S_F$ at which the system is operating is sensed as having changed, and the changed value is supplied to the relay function 19.

The temperature relay 19 changes the proportion of sludge combustion air to fuel combustion air. The new sludge combustion air rate is the sum of the original air rate, $A_c$, plus a new incremental change, $\Delta A_{c2}$, and the new fuel air rate is the original rate, $A_b$, plus a new incremental change, $A_{b2}$ which causes a new incremental change in the fuel energy release, $\Delta E_{b2}$. This increases the denominator of equation (8) until the calculated value of $S_F$ returns to the set point value $S_F$, i.e.

$$K\left[\frac{A_c + \Delta A_{c2} + (A_b + \Delta A_{b2})}{E_c + (E_b + \Delta E_{b2})}\right] = S_F \tag{10}$$

where $\Delta A_{c2} < \Delta A_{c1}$ $\Delta A_{b2} > \Delta A_{b1}$ $\Delta E_{b2} > \Delta E_{b1}$ Again, after a time the oxygen sensor 14 will sense the increased amount of oxygen to the afterburner from the furnace as a result of the proportionality change of the fuel combustion air and sludge combustion air, and will in turn control valve 15 to change thus causing the gas flow sensor to provide the changed output to the $S_F$ controller 20. The results will be to have the output of controller 20 return to the original value, and to discontinue changing the action of the relay function 19, leaving the valves 23 and 24 set at the new proportionality.

When the sludge quality changes by a change in the energy value of combustibles in the sludge, the chemical energy $E_c$ in the sludge will change correspondingly, requiring a change in the amount of fuel which must be added to the furnace to keep equation (6) in balance. This assumes that combustibles load $L_c$ does not change sufficiently to require a change in auxiliary fuel energy $E_b$.

For example, when the energy $E_c$ in the sludge increases and the loads remain substantially unchanged, the temperatures on the burner hearths will remain substantially the same. However, the volatilized combustibles from the sludge will have increased fuel value, reducing the stoichiometric value of the furnace, and in the afterburner more of the oxygen being supplied in the afterburner air will be consumed in burning the added sludge volatiles. Oxygen sensor 14 will then sense that the oxygen content of gases from the afterburner has fallen below the predetermined excess amount, and as a result the valve 15 will be opened, causing the same action as above in the output of the stoichiometric controller 20. The changed stoichiometric value at which the furnace is operating will be supplied to the relay function 19, which in turn will change the ratio of the fuel combustion air to sludge combustion air as described above. The change in the ratio will be opposite to that described above for the case where the change in the sludge was a change in the load, since in the present case, the increased energy causes a drop in the percent stoichiometric air value at which the furnace is operating instead of an increase. The change in the ratio is in a direction to increase the proportion of sludge combustion air and decrease fuel combustion air, and, it would be noted, does not affect the temperature controller 18. This will then cause a change in the composition of the furnace gases which will be sensed by the oxygen sensor 14, which in turn will cause the output of controller 20 to return to the original percent stoichiometric air value.

The time constants for the respective control loops are different, the time constant for the hearth control temperature loop being on the order of a few seconds, and the time constant for the second control loop being at least four or more times the time constant of the hearth temperature control loop.

The foregoing discussion of the hearth temperature control loop and second control loop assumes that the ratio of the fuel combustion air and fuel supplied to the burners is constant, and varying one will vary the other to maintain the constant proportion. It is possible, however, to have the fuel combustion air and fuel supplied in a varying proportion. In such case the relay function 19 must be operated such as to vary the sludge combustion air flow somewhat differently so that the total of the sludge combustion air and fuel combustion air supplied to a hearth is proper for adjusting the temperature of the hearth in the right direction.

Having described the invention, we claim:

1. In a method for controlling the operation of a two stage furnace to efficiently incinerate combustible material in a starved-air mode, a primary stage having means to introduce combustible material therein as well as auxiliary fuel burner(s) and combustion air flow means for introducing flows of auxiliary fuel-air mixture and combustion air, respectively, into said primary stage at substoichiometric air conditions to pyrolyze the combustible material at predetermined set point(s) and a secondary stage connected to said primary stage to receive gas and vapor products from said primary stage, said secondary stage including secondary combustion airflow means for introducing a flow of secondary combustion air and being operated at excess air conditions at a predetermined minimum temperature to combust said gas and vapor products from the primary stage, and wherein the combusted gas and vapor products are discharged as flue gas from the secondary stage, the improvement which comprises the steps of:

(a) measuring the oxygen concentration in the flue gas discharged from said secondary stage:

(b) measuring the air flow rates to each of the primary and secondary stages of said furnace, and using said measured rates and said measured oxygen concentration to compute the primary stage air rate as a percentage or fractional value of the stoichiometric air rate;

(c) establishing a predetermined set-point control value of said primary stage percent stoichiometric air to achieve the desired efficient furnace operation;

(d) comparing said computed percent stoichiometric air value from step (b) with said predetermined set-point control value of primary stage percent stoichiometric air;

(e) establishing a predetermined set-point control value of primary stage temperature;

(f) measuring said primary stage temperature and comparing said primary stage temperature with said predetermined set-point control value of primary stage temperature;

(g) controlling said flows of auxiliary fuel-air mixture to said burner(s) and air to said combustion air flow means to simultaneously maintain said primary stage temperature at its predetermined set-point control value and said primary stage percent stoichiometric air at its predetermined set-point control value, said control of primary stage comprising:

(x) correcting variations in primary stage temperature to the predetermined temperature set-point value by regulating changes in flow rate of said auxiliary fuel-air mixture at a pre-set finite minimal relay function and regulating changes in said combustion air flow rate at a pre-set finite maximum relay function, provided computed primary stage percent stoichiometric air is below said predetermined set-point control value of percent stoichiometric air in the primary stage;

(xx) regulating changes in flow rates of said fuel-air mixture and said combustion air when said computed primary stage percent stoichiometric air is at the predetermined set point value wherein as the heat required to maintain said predetermined set-point temperature increases, the relay function for regulating said fuel-air mixture is continuously modulated from said pre-set minimum value to a pre-set finite maximum value, and the relay function for regulating said combustion air rate is continuously modulated from said pre-set maximum value to a pre-set finite minimum value, the resulting said changes in flow rates acting to satisfy said heat requirement without changing said computed primary stage percent stoichiometric air; and (xxx) correcting variations in the temperature in said primary stage to the predetermined set-point value, when said computed primary stage percent stoichiometric air exceeds the predetermined set point control value wherein said relay function for regulating said fuel-air mixture is maintained at pre-set maximum value, and said relay function for regulating said combustion air mixture is maintained at said pre-set minimum value.

2. A method according to claim 1, comprising the further steps of:

(h) establishing a maximum value of primary stage percent stoichiometric air, said maximum value of percent stoichiometric air higher than said set-point control value of percent stoichiometric air; and (i) controlling said primary stage combustion air rate to maintain said percent stoichiometric air at a value not greater than said maximum value.

* * * * *